United States Patent [19]

Metrailer et al.

[11] 4,169,038

[45] Sep. 25, 1979

[54] COMBINATION HYDROCONVERSION, FLUID COKING AND GASIFICATION

[75] Inventors: William J. Metrailer; Roby Bearden, Jr.; Clyde L. Aldridge, all of Baton Rouge, La.

[73] Assignee: Exxon Research & Engineering Co., Florham Park, N.J.

[21] Appl. No.: 889,744

[22] Filed: Mar. 24, 1978

[51] Int. Cl.[2] ..... C10G 1/08; C10G 9/32

[52] U.S. Cl. ..... 208/10; 208/50; 208/127

[58] Field of Search ..... 208/50, 127, 8 R, 10

[56] References Cited

U.S. PATENT DOCUMENTS

| | | | |
|---|---|---|---|
| 2,738,307 | 3/1956 | Beckberger | 208/55 |
| 3,617,481 | 11/1971 | Voorhies et al. | 208/50 |
| 3,702,516 | 11/1972 | Luckenbach | 208/127 |
| 3,779,900 | 12/1973 | Molstedt | 208/127 |
| 4,055,484 | 10/1977 | Blaser et al. | 208/127 |

*Primary Examiner*—Herbert Levine

*Attorney, Agent, or Firm*—Marthe L. Gibbons

[57] ABSTRACT

A combination slurry hydroconversion, coking and coke gasification process is provided wherein solid fines having an average particle size of less than 10 microns in diameter or the ashes thereof recovered from a gaseous product derived from the coke gasification are used as a catalyst in the hydroconversion stage.

14 Claims, 1 Drawing Figure

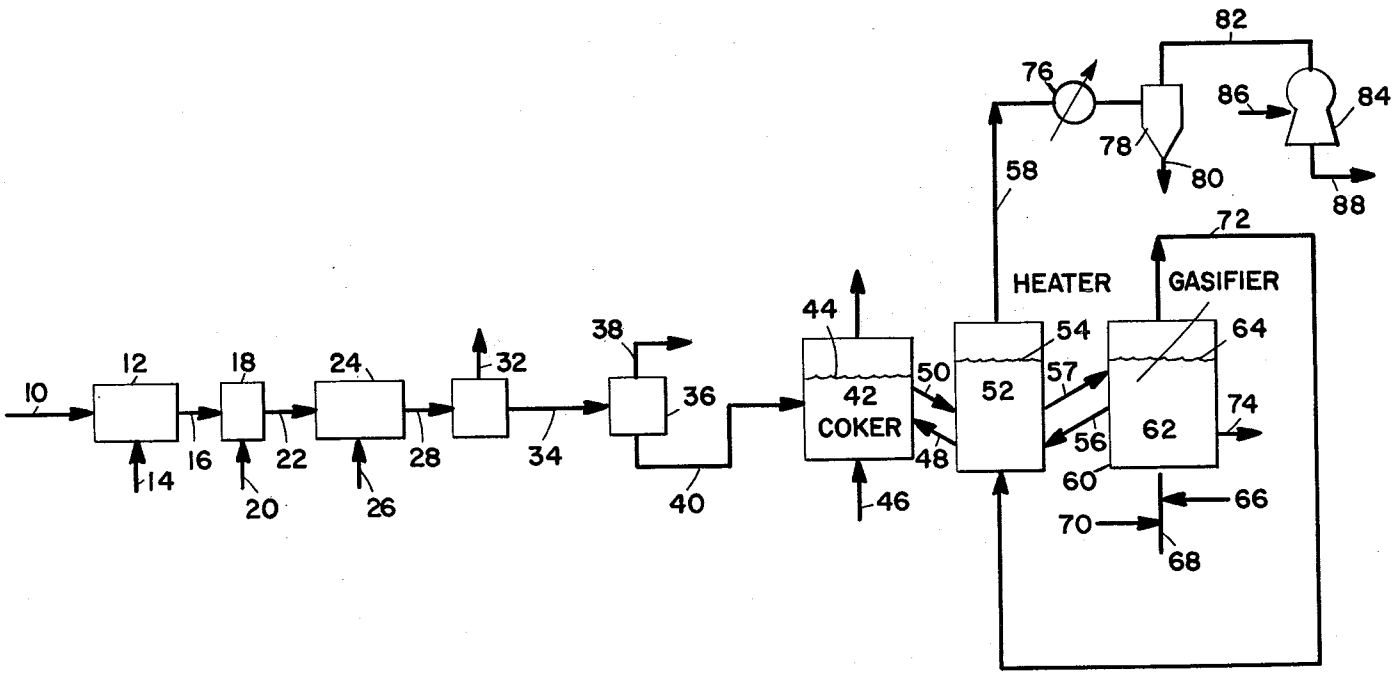
10
12
14
16
18
20
22
24
26
28
32
34
36
38
40
42
COKER
44
46
48
50
52
HEATER
54
57
56
58
60
62
GASIFIER
64
66
68
70
72
74
76
78
80
82
84
86
88

COMBINATION HYDROCONVERSION, FLUID COKING AND GASIFICATION

BACKGROUND OF THE INVENTION

1. Field of the Invention

This invention relates to a combination process for upgrading carbonaceous materials to produce normally liquid hydrocarbonaceous products. It particularly relates to a combination slurry hydroconversion process and a coking and coke gasification process wherein the solid fines produced by gasification of the coke are used as a catalyst in the slurry hydroconversion process. The term "fines" is intended herein to designate particles having an average diameter of less than 10 microns.

2. Description of the Prior Art

Catalytic slurry processes for the hydrogenative conversion of heavy oils are known. See, for example, U.S. Pat. Nos. 3,617,503; 3,297,563 and 3,622,498.

It is also known to produce hydrogen-containing gases and coke by integrated fluid coking and coke gasification processes such as those disclosed in U.S. Pat. Nos. 3,661,543; 3,702,516; and 3,759,676, the teachings of which are hereby incorporated by reference.

A process is known for upgrading heavy mineral oils by reaction with hydrogen in the presence of a catalyst comprising a solid carbon-containing material and an alkali metal component. See, U.S. Pat. No. 3,923,635.

U.S. Pat. No. 3,617,481 discloses a combination hydrotreating, coking and coke gasification process in which the metals-containing coke gasification residue is used as catalyst in the hydrotreating stage.

It has now been found that a combination slurry hydroconversion, fluid coking and coke gasification process in which the solid fines resulting from the gasification are used as a catalyst for the hydroconversion process will provide advantages that will become apparent in the ensuing description.

SUMMARY OF THE INVENTION

In accordance with the invention there is provided, a process for upgrading a carbonaceous chargestock which comprises: (a) adding to said chargestock solid carbonaceous fines resulting from step (k) to form a mixture, said fines having an average particle size of less than about 10 microns in diameter and a surface area of less than about 50 $m^2/g$; (b) reacting the chargestock containing said catalytic fines with a molecular hydrogen-containing gas under hydroconversion conditions in a hydroconversion zone to produce a hydrocarbonaceous oil product; (c) separating a heavy oil fraction from said hydrocarbonaceous oil product; (d) contacting at least a portion of said separated heavy oil fraction with a bed of fluidized solids maintained in a fluid coking zone under fluid coking conditions to form coke, said coke depositing on said fluidized solids; (e) introducing a portion of said solids with a coke deposition thereon into a heating zone operated at a temperature greater than said coking zone temperature to heat said portion of solids; (f) recycling a first portion of heated solids from said heating zone to said coking zone; (g) introducing a second portion of said heated solids to a fluid bed gasification zone maintained at a temperature greater than the temperature of said heating zone; (h) reacting said second portion of heated solids in said gasification zone with steam and a molecular oxygen-containing gas to produce a hot gaseous stream containing hydrogen; (i) introducing said hot gaseous stream containing hydrogen and entrained solids into said heating zone; (j) recovering from said heating zone the resulting cooled gaseous stream containing hydrogen and entrained solid carbonaceous fines and (k) separating at least a portion of said solid carbonaceous fines from said cooled gaseous stream, said separated fines having an average particle size of less than about 10 microns in diameter.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a carbonaceous material is passed by line 10 to a mixing zone 12. Suitable carbonaceous materials for introduction into the mixing zone include heavy and reduced petroleum crudes, atmospheric distillation bottoms, vacuum distillation bottoms, pitch, asphalt, bitumen, other heavy hydrocarbon residua, liquids derived from coal liquefaction processes, shale oil, tar sand oil; slurries of coal and hydrogen donor solvents; slurries of coal in other non-aqueous liquid media such as petroleum residua; and mixtures of any of these carbonaceous materials. Catalytic solid fines produced, as will hereinafter be described, are introduced into mixing zone 12 by line 14. Optionally, the liquid feed may be used to scrub the gases from the heater, after partial cooling, and to recover the catalytic fines. Desirably, a sufficient amount of catalytic solid fines are added to the mixing zone to provide a content of the solid fines from about 0.1 to 20 weight percent based on the carbonaceous chargestock to the mixing zone, preferably to provide solid fines from about 0.5 to about 10 weight percent based on the carbonaceous chargestock, more preferably from about 1 to about 5 weight percent solid fines based on the chargestock.

If desired, other catalytic components, such as red mud, may be added to the chargestock. The resulting mixture is removed from mixing zone 12 by line 16 and, optionally, passed to a pretreatment zone 18 where the mixture is contacted with a gas comprising hydrogen sulfide alone or a gas comprising hydrogen and from about 1 to about 90 mole percent hydrogen sulfide. Pretreatment zone, when used, is operated at a temperature ranging from about 615° to 780° F. and at a pressure ranging from about 500 to 5000 psig. The pretreated slurry is removed from pretreatment zone 18 by line 22 and passed to hydroconversion zone 24. When no pretreatment is used, the slurry is passed from the mixing zone to the hydroconversion zone. The term "hydroconversion" is used herein to designate a process conducted in the presence of hydrogen in which at least a portion of the heavy constituents of the chargestock is converted to lower boiling hydrocarbon products. A hydrogen-containing gas is introduced into the hydroconversion zone 24 by line 26. As will readily be apparent, this gas could be introduced into the feed line entering the hydroconversion zone. Optionally, the hydrogen-containing gas may also comprise from about 1 to about 10 mole percent of hydrogen sulfide, preferably from about 2 to about 7 mole percent hydrogen sulfide. The hydroconversion zone is maintained at a temperature ranging from about 650° to about 1000° F., preferably from about 790° to about 900° F., more preferably from about 800°to about 850° F. and at a hydrogen partial pressure ranging from about 500 to about 5000 psig, preferably from about 1000 to about 3000 psig. The slurry of carbonaceous feed and catalytic solid fines is introduced into the hydroconversion zone at a space velocity ranging from about 0.1 to 10 volumes of chargestock per hour per volume of reactor, preferably from about 0.25 to about 6 V/Hr./V. The hydroconversion zone effluent is removed by line 28 and passed to a gas-liquid separation zone 30. The gaseous effluent of separation zone 30 is removed by line 32. Since this gas comprises hydrogen, it may be recycled, if desired after prior cleanup, for use as hydrogen in the hydroconversion zone. The liquid product is removed by line 34 and passed to a separation zone from which a lighter carbonaceous oil, such as, for example, a fraction boiling below 1050° F. at atmospheric pressure is recovered by line 38. The bottoms portion or heavy oil fraction is removed by line 40 and passed as feed to a coking zone 42 in which is maintained a fluidized bed of solids (e.g. coke particles of 40 to 1000 microns in size) having an upper level indicated at 44. A fluidizing gas, e.g. steam, is admitted at the base of the coking reactor through line 46 in an amount sufficient to obtain a superficial fluidizing gas velocity in the range of 0.5 to 5 feet per second. Coke at a temperature above the actual coking temperature, for example, at a temperature from about 100° to about 800 Fahrenheit degrees in excess of the actual operating temperature of the coking zone, is admitted into the coking zone by line 48 in an amount sufficient to maintain the coking temperature in the range of about 850° to about 1400° F. The pressure in the coker is maintained in the range from about 5 to about 150 psig, preferably from about 5 to about 45 psig. The lower portion of the coker serves as stripping zone to remove occluded hydrocarbons from the coke. A stream of coke is withdrawn from the stripping zone by line 50 and circulated to a heater 52.

In heater 52, stripped coke from the coker is introduced by line 50 to a fluid bed of hot coke having an upper level indicated at 54. The bed is partially heated by passing a gaseous stream into the heater by line 72. This gaseous stream is the effluent of a gasification zone as will be described hereinafter. Supplemental heat is supplied by coke circulating in line 56. The gaseous effluent of the heater is removed by line 58. The heater gaseous effluent, containing entrained solid carbonaceous fines, is passed by line 58, if desired through an indirect heat exchanger 76 and then into a cyclone 78 in which a portion of the entrained solid fines is separated and removed from the cyclone as dry fines by line 80. A gaseous hydrogen-containing stream, including the remaining entrained solids, is removed from cyclone 78 by line 82 and passed to a wet scrubber 84 such as, for example, a venturi scrubber, a packed bed, a wet cyclone or other conventional equipment, in which the solids-containing gas is scrubbed with a liquid introduced by line 86. Optionally, the liquid used may be the carbonaceous feed of the process. At least a portion of the solids present in the gaseous stream is separated from the gas to form with the scrubbing liquid a solid fines-liquid slurry which is removed from the scrubber by line 88. The carbonaceous solid fines are recovered from the liquid slurry by conventional means. The recovered fines have an average particle size of less than about 10 microns in diameter, preferably a particle size of less than 5 microns in diameter, and have surface areas of less than 50 square meters per gram. These recovered carbonaceous solid fines are catalytic in nature and are used as the catalyst for the hydroconversion stage of the present invention. Instead of recovering the fines by a wet scrubbing method, the fines may be recovered by electrostatic precipitation. Alternatively, the separated carbonaceous fines may be burned by heating them in the presence of a molecular oxygen-containing gas to remove most of the carbon present therein and to produce an ash having an average particle size of less than about 5 microns in diameter which also may be used as catalyst for the hydroconversion stage of the present invention. Furthermore, if desired, the carbonaceous fines or the ashes derived therefrom may be sulfided in a conventional way prior to passing them to the hydroconversion stage. Hot coke is removed from the fluidized bed in heater 52 and recycled to the coking zone by line 48 to supply heat thereto. Another portion of the coke is removed from heater 52 by line 57, and passed to a gasification zone 62 in gasifier 60 in which is maintained a bed of fluidized coke having a level indicated at 64. The gasification zone is maintained at a temperature ranging from about 1200° to about 2000° F. and at a pressure ranging from about 5 to about 150 psig, preferably at a pressure ranging from about 10 to about 60 psig.

A molecular oxygen-containing gas, such as air, commercial oxygen or air enriched with oxygen, is introduced into line 68 by line 66 and steam is introduced into line 68 by line 70. The stream of line 68 is passed into the gasifier. Contact of the coke with the steam and oxygen-containing gas under gasification conditions in the gasifier produces a hydrogen-containing gas and a carbonaceous solid residue. The hydrogen-containing gas, which comprises entrained solid fines, is removed from the gasifier by line 72 and passed into heater 52 from which the stream will be recovered by line 58. Alternatively, at least part of the gases may be passed into a separate solids recovery system (not shown). A carbonaceous residue is removed as purge stream from the gasifier by line 74. This product contains metals derived from the oil or coal feed, that is, usually vanadium, iron and nickel, and, in addition, any of the added catalytic components. The gaseous effluent removed by line 58 from the heater comprises hydrogen.

The following examples are presented to illustrate the invention.

EXAMPLE 1

Solid fines recovered by a venturi scrubbing process from the gaseous product of the gasification stage of an integrated fluid coking and gasification process were utilized for the hydroconversion of a Cold Lake crude oil. The carbonaceous solid fines were derived from coking a Boscan crude oil. The solids as the carbonaceous fines or as ashes derived therefrom were added to the Cold Lake crude. When pretreatment was used, the mixture was pretreated with a gaseous mixture comprising hydrogen and 13 mole percent hydrogen sulfide at 725° F. for 30 minutes. The pretreated slurry or non-pretreated slurry was then hydroconverted with hydrogen at a temperature ranging from 820° F. to 830° F. for 1 hour at an average hydrogen partial pressure of about 3000 psig. The results of these experiments are summarized in Table I.

TABLE I

| Run No. | 21-R-03 | 21-R-22 | 21-R-23 | 21-R-12 | 21-R-13 | 21-R-14 | 6R-34 |
|---|---|---|---|---|---|---|---|
| Catalyst | carbonaceous fines | | | | burned ash(1) | | None |
| Wt. % on feed | 0.5 | 1.6 | 1.6 | 0.16 | 1.6 | 1.6 | — |
| Average particle size, microns | 2 | 2 | 2 | 1 | 1 | 1 | — |
| $H_2$ + $H_2S$ Pretreat | Yes | Yes | No | Yes | Yes | No | Yes |
| Hydrocon. Cond. | | | | | | | |
| Temp., °F. | 820 | 820 | 830 | 820 | 820 | 830 | 820 |
| Time | | | | 1 Hr. | | | — |
| $H_2$ pressure, psig | | | | 3000 | | | |
| $C_1$–$C_4$, wt. % on feed | 5.0 | 2.40 | 5.86 | 4.41 | 3.34 | 4.6 | 6.5 |
| Coke, wt. % on feed | 2.7 | 0.60 | 1.2 | 2.4 | 0.47 | 0.9 | 5.5 |
| Con. Carbon Conv. % | 49 | 51 | 53 | 56 | 52 | 59 | 47 |
| CPF(2) | 0.43 | 0.09 | 0.17 | 0.33 | .07 | 0.12 | 0.92 |
| Liquid API | 22.2 | — | 23.0 | 23.4 | 22.0 | 22.7 | 19.5 |

(1)Burned at 454° C.

(2)Coke Production Factor = $\frac{\text{Weight of Coke Made}}{\text{Weight of Con Carbon in feed} - \text{Weight of Conradson Carbon in Products}}$ As can be seen from the data of the above table, the carbonaceous fines as well as the carbon-free ashes derived therefrom (burned ash) are active catalysts.

The burned ash was effective at lower concentration than the unburned solid fines. Compare runs 21-R-03 and 21-R-12. Presulfiding in situ appears to be beneficial for the carbonaceous fines as well as for the essentially carbon-free ashes derived therefrom (burned ash). Compare run 21-R-22 with 21-R-23.

EXAMPLE 2

Experiments were made utilizing carbonaceous fines of the present invention (run 21-R-22) and burned ashes of the present invention (run 21-R-13) and a gasification residue (run 60-R-31) which is a catalyst of the type described in U.S. Pat. No. 3,617,481. The results of these experiments are summarized in Table II. As can be seen from Table II, the catalyst of the present invention gave better conversion performance on a weight-on-feed equivalent basis than the catalyst of the type described in U.S. Pat. No. 3,617,481 (run 60-R-31). The catalyst of the present invention also gave much better gas and coke control than said prior art catalyst.

TABLE II

SLURRY HYDROCONVERSION OF COLD LAKE CRUDE

In situ pretreat at 725° F., 30 minutes, 13 mole percent $H_2S$ in $H_2$.
Run at 820° F., 60 minutes.

| Run No.<br>Catalyst | 60-R-31<br>Gasifier Residue | 21-R-22<br>Carbonaceous Fines | 21-R-13<br>Burned Ashes |
|---|---|---|---|
| Wt. % on Feed | 1.6 | 1.6 | 1.6 |
| Catalyst Inspections | | | |
| Surface Area, $m^2/g$ | 125 | 31 | 5 |
| Average Particle Size, Microns | 150 | 2 | 1 |
| Carbon, Wt. % | 88.01 | 64.11 | 0 |
| Hydrogen, Wt. % | 0.56 | 0.75 | 0 |
| Vanadium, Wt. % | 3.0 | 15.7 | ≈45 |
| Nickel, Wt. % | 0.3 | 1.5 | ≈4 |
| Conversion Yields, Wt. % | | | |
| $C_1$-$C_4$ | 4.6 | 2.4 | 3.3 |
| Coke | 3.6 | 0.6 | 0.5 |
| Conversion Summary | | | |
| Desulfurization, % | 32 | 43 | 42 |
| Conradson Carbon Conv., % | 49 | 51 | 52 |

What is claimed:

1. A process for upgrading a liquid-comprising carbonaceous chargestock which comprises:

(a) adding to said chargestock catalytic solids consisting essentially of carbonaceous fines resulting from step (k) to form a mixture, said fines having an average particle size of less than about 10 microns in diameter and a surface area of less than about 50 $m^2/g$;

(b) reacting the chargestock containing said catalytic fines with a molecular hydrogen-containing gas under hydroconversion conditions in a hydroconversion zone to produce a hydrocarbonaceous oil product;

(c) separating a heavy oil fraction from said hydrocarbonaceous oil product;

(d) contacting at least a portion of said separated heavy oil fraction with a bed of fluidized solids maintained in a fluid coking zone under fluid coking conditions to form coke, said coke depositing on said fluidized solids;

(e) introducing a portion of said solids with a coke deposition thereon into a heating zone operated at a temperature greater than said coking zone temperature to heat said portion of solids;

(f) recycling a first portion of heated solids from said heating zone to said coking zone;

(g) introducing a second portion of said heated solids to a fluid bed gasification zone maintained at a temperature greater than the temperature of said heating zone;

(h) reacting said second portion of heated solids in said gasification zone with steam and a molecular oxygen-containing gas to produce a hot gaseous stream containing hydrogen;

(i) introducing said hot gaseous stream containing hydrogen and entrained solids into said heating zone;

(j) recovering from said heating zone the resulting cooled gaseous stream containing hydrogen and entrained solid carbonaceous fines, and (k) separating at least a portion of said solid carbonaceous fines from said cooled gaseous stream, said separated fines having an average particle size of less than about 10 microns in diameter.

2. The process of claim 1 wherein prior to step (b), said mixture of chargestock and carbonaceous fines is treated with a gas comprising hydrogen and from about 1 to about 90 mole percent hydrogen sulfide.

3. The process of claim 2 wherein said treatment is conducted at a temperature ranging from about 615° to about 980° F. and at a pressure ranging from about 500 to about 5000 psig.

4. The process of claim 1 wherein prior to adding said catalytic solid carbonaceous fines to said chargestock, the fines are burned to reduce the concentration of carbon of said fines and to produce an ash and, thereafter, the resulting ash is added to said chargestock.

5. The process of claim 1 wherein said catalytic solid fines are added to said chargestock in an amount sufficient to provide from about 0.1 to 20 weight percent solid fines, based on said chargestock.

6. The process of claim 1 wherein said catalytic solid fines are added to said chargestock in an amount sufficient to provide from about 0.5 to about 10 weight percent solid fines, based on said chargestock.

7. The process of claim 1 wherein said catalytic solid fines are added to said chargestock in an amount sufficient to provide from about 1 to about 5 weight percent solid fines, based on said chargestock.

8. The process of claim 1 wherein said hydroconversion conditions include a temperature ranging from about 650° F. to about 1000° F. and a hydrogen partial pressure ranging from about 500 psig to about 5000 psig.

9. The process of claim 1 wherein said hydroconversion conditions include a temperature ranging from about 790° to about 900° F. and a hydrogen partial pressure ranging from about 1000 to about 3000 psig.

10. The process of claim 1 wherein said fluid coking conditions include a temperature ranging from about 850° to about 1400° F. and a pressure ranging from about 5 to about 150 psig.

11. The process of claim 1 wherein said gasification conditions include a temperature ranging from about 1200° to about 2000° F. and a pressure ranging from about 5 to about 150 psig.

12. The process of claim 1 wherein said chargestock comprises a hydrocarbonaceous oil.

13. The process of claim 1 wherein said chargestock comprises coal.

14. The process of claim 1 wherein other catalytic compounds are added to said chargestock.

* * * * *